US011034575B2

(12) United States Patent
Hausner et al.

(10) Patent No.: US 11,034,575 B2
(45) Date of Patent: Jun. 15, 2021

(54) BARREL PUMP HAVING A FOLLOWER PLATE WITH AN ADJUSTABLE SEALING RING

(71) Applicant: Atlas Copco IAS GmbH, Bretten (DE)

(72) Inventors: Thomas Hausner, Bretten (DE); Gerrit Enderle, Knittlingen (DE); Siegmund Oberhofer, Pforzheim (DE)

(73) Assignee: Atlas Copco IAS GmbH, Bretten (DE)

( * ) Notice: Subject to any disclaimer, the term of this patent is extended or adjusted under 35 U.S.C. 154(b) by 211 days.

(21) Appl. No.: 16/325,459

(22) PCT Filed: Aug. 15, 2017

(86) PCT No.: PCT/EP2017/070672
§ 371 (c)(1),
(2) Date: Feb. 14, 2019

(87) PCT Pub. No.: WO2018/041628
PCT Pub. Date: Mar. 8, 2018

(65) Prior Publication Data

US 2019/0210865 A1 Jul. 11, 2019

(30) Foreign Application Priority Data

Sep. 5, 2016 (DE) ..... 10 2016 010 622.0
Jan. 16, 2017 (DE) ..... 10 2017 100 712.1

(51) Int. Cl.
*B67D 7/64* (2010.01)
*B05C 11/10* (2006.01)

(52) U.S. Cl.
CPC ..... *B67D 7/645* (2013.01); *B05C 11/10* (2013.01)

(58) Field of Classification Search
CPC .... A47K 5/1217; B65D 83/26; B65D 83/262; B65D 83/0044; B65D 83/0022;
(Continued)

(56) References Cited

U.S. PATENT DOCUMENTS 2,341,128 A 2/1944 Titus et al.
2,630,248 A 3/1953 Hinz
(Continued)

FOREIGN PATENT DOCUMENTS

CN 1402649 A 3/2003
CN 1759064 A 4/2006
(Continued)

OTHER PUBLICATIONS

International Search Report in PCT/EP2017/070672, dated Dec. 14, 2017.
(Continued)

*Primary Examiner* — Vishal Pancholi
*Assistant Examiner* — Robert K Nichols, II
(74) *Attorney, Agent, or Firm* — Collard & Roe, P.C.

(57) ABSTRACT

A method for conveying viscous material out of a barrel-like container open towards the top and having a bottom and a circumferential wall extending from bottom to top, uses a device having a follower plate for closing the container. The plate has a circumferential wiper ring having a radially outwardly protruding contact portion for contacting an inner container wall face facing the plate. A variable pressing force can be applied to press the contact portion against the inner face. The plate, following a decreasing material level and resting on the material surface, is moved bottomward, and, after the container is emptied, is moved away from the bottom, and the contact portion is pressed sealingly against the inner face while the plate moves bottomward. The sealing effect between the wiper ring and the container wall is suspended during plate movement away from the bottom by reducing the pressing force.

13 Claims, 4 Drawing Sheets

Figure 1:
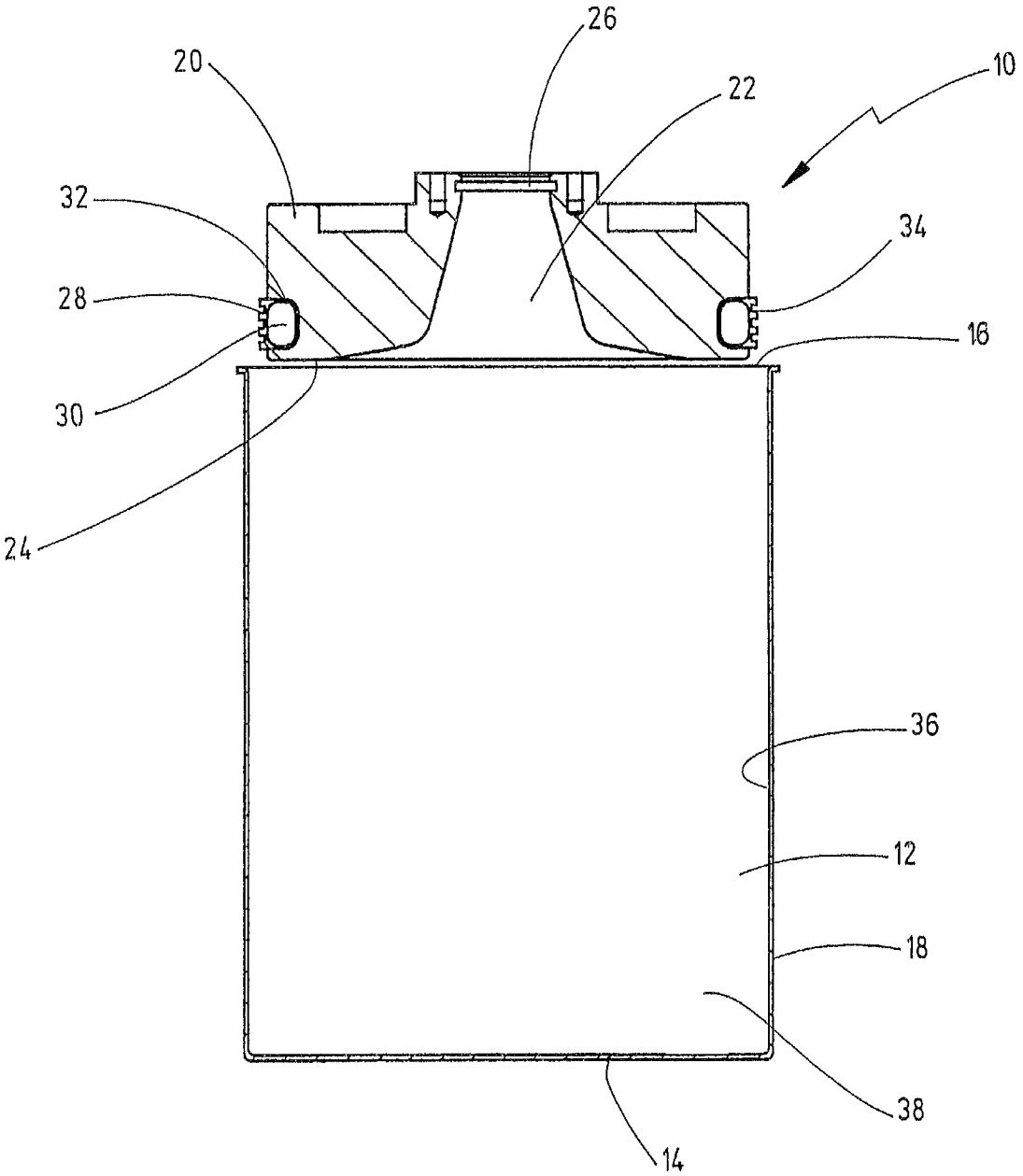

(58) Field of Classification Search
CPC ..... F04B 13/00; F04B 15/02; B67D 7/0227; B67D 7/645; B05C 11/10
USPC ..... 222/405, 52, 61, 63, 386, 389, 261–263, 222/100, 146.5, 259, 326
See application file for complete search history.

(56) References Cited

U.S. PATENT DOCUMENTS

| | | | | |
|---|---|---|---|---|
| 3,031,106 | A | 4/1962 | Hooker | |
| 3,895,745 | A | 7/1975 | Hook | |
| 3,976,229 | A | 8/1976 | Jackson | |
| 3,982,669 | A | 9/1976 | Moore | |
| 4,073,409 | A | 2/1978 | Gardner et al. | |
| 4,195,755 | A | 4/1980 | Slautterback et al. | |
| 4,632,281 | A | 12/1986 | Wold | |
| 4,651,897 | A | 3/1987 | Johnson | |
| 4,661,688 | A * | 4/1987 | Gabryszewski ..... | B67D 7/645 219/421 |
| 4,790,456 | A | 12/1988 | Nakane et al. | |
| 5,248,069 | A | 9/1993 | Consaga et al. | |
| 5,257,723 | A | 11/1993 | Bagung | |
| 6,003,732 | A | 12/1999 | Farley et al. | |
| 6,082,888 | A | 7/2000 | Sakayori | |
| 6,131,766 | A | 10/2000 | King et al. | |
| 6,206,248 | B1 * | 3/2001 | Popp ..... | B67D 7/0227 141/287 |
| 6,325,932 | B1 | 12/2001 | Gibson | |
| 6,457,356 | B1 | 10/2002 | Meloche | |
| 6,635,183 | B2 | 10/2003 | Gibson | |
| 6,860,696 | B2 | 3/2005 | Bazan | |
| 7,383,967 | B2 | 6/2008 | Gibson | |
| 7,762,428 | B2 | 7/2010 | Scheugenpflug | |
| 8,544,699 | B2 | 10/2013 | Quam | |
| 8,955,534 | B2 | 2/2015 | Yang | |
| 10,486,958 | B1 | 11/2019 | Hryckowian et al. | |
| 2001/0025864 | A1 | 10/2001 | Meyer | |
| 2004/0050771 | A1 | 3/2004 | Gibson | |
| 2008/0023082 | A1 | 1/2008 | Schucker | |
| 2008/0067192 | A1 | 3/2008 | Stanton et al. | |
| 2011/0171042 | A1 | 7/2011 | Quam | |
| 2016/0002025 | A1 | 1/2016 | Waizenauer et al. | |
| 2016/0016785 | A1 | 1/2016 | Tartler | |
| 2018/0339896 | A1 | 11/2018 | Tartler | |
| 2019/0314858 | A1 | 10/2019 | Tasaka et al. | |
| 2019/0367352 | A1 | 12/2019 | Hausner et al. | |
| 2020/0017353 | A1 | 1/2020 | Tartler | |
| 2020/0018299 | A1 | 1/2020 | Mori et al. | |
| 2020/0063726 | A1 | 2/2020 | Enderle et al. | |

FOREIGN PATENT DOCUMENTS

| | | | |
|---|---|---|---|
| CN | 101535148 | A | 9/2009 |
| CN | 102954225 | A | 3/2013 |
| CN | 103249496 | A | 8/2013 |
| CN | 103449347 | A | 12/2013 |
| CN | 105377745 | A | 3/2016 |
| DE | 91 01 116 | U1 | 8/1991 |
| DE | 44 19 536 | A1 | 12/1995 |
| DE | 201 02 413 | U1 | 6/2001 |
| DE | 197 13 938 | C2 | 4/2003 |
| DE | 20 2004 009 185 | U1 | 10/2005 |
| DE | 10 2004 030 654 | A1 | 1/2006 |
| DE | 198 47 031 | B4 | 2/2008 |
| DE | 20 2011 108 222 | U1 | 2/2012 |
| DE | 20 2013 009 164 | U1 | 11/2013 |
| EP | 0 943 583 | A1 | 9/1999 |
| EP | 2 801 462 | A1 | 11/2014 |
| FR | 2 409 938 | A1 | 6/1979 |

OTHER PUBLICATIONS

German Office Action in DE 10 2016 010 622.0, dated Dec. 15, 2016, with English translation of relevant parts.
German Office Action in DE 10 2017 100 712.1, dated Sep. 18, 2017, with English translation of relevant parts.
Chinese Office Action dated Nov. 4, 2020 in Chinese Application No. 201780083233.4.
English translation of the International Preliminary Report on Patentability and Written Opinion of International Searching Authority in PCT/EP2017/070672, dated Mar. 14, 2019.
Chinese Office Action dated Jul. 22, 2020 in Chinese Application No. 201780053973.3, with English translation.
International Search Report in PCT/EP2017/081973, dated Apr. 19, 2018.
English translation of the International Preliminary Report on Patentability and Written Opinion of the International Searching Authority in PCT/EP2017/081973, dated Jul. 25, 2019.

* cited by examiner

BARREL PUMP HAVING A FOLLOWER PLATE WITH AN ADJUSTABLE SEALING RING

CROSS REFERENCE TO RELATED APPLICATIONS

This application is the National Stage of PCT/EP2017/070672 filed on Aug. 15, 2017, which claims priority under 35 U.S.C. § 119 of German Application Nos. 10 2016 010 622.0 filed on Sep. 5, 2016 and 10 2017 100 712.1 filed on Jan. 16, 2017, the disclosures of which are incorporated by reference. The international application under PCT article 21(2) was not published in English.

The invention relates to a method for conveying viscous material, in accordance with the preamble of claim 1.

In DE 10 2004 030 654 A1, an apparatus is described, which serves for conveying viscous material, in particular adhesives, sealants, insulation materials or heat-conduction pastes, from a barrel to a processing station. Such apparatuses are used, in particular, in the motor vehicle industry, when viscous material must be applied to car body parts. The follower plate, which is affixed to a frame, lies on the surface of the material situated in the container, configured as a barrel, and follows this surface as the material level drops. The material is removed from the barrel by means of a pump, wherein the follower plate is made to follow the material surface. In this regard, it is also possible that the follower plate additionally presses on the material surface, so that the material is pressed into the material outlet due to this pressure. In this regard, the wiper ring lies against the inner surface of the container wall, and for one thing seals the interior of the barrel off from the surroundings. For another thing, it wipes off material adhering to the inner surface of the barrel wall as the follower plate is lowered. Once the barrel has been emptied, it must be replaced with a new, full barrel. For this purpose, the follower plate must be moved upward out of the barrel. In order to be able to move the follower plate upward in the barrel, the interior of the barrel must be ventilated, since otherwise, a vacuum would be formed in the barrel, and this would prevent the follower plate from being moved out. This is achieved, in the case of previously known apparatuses, in that compressed air is introduced into the barrel through a ventilation opening in the follower plate. Since the follower plate has a large surface area, an excess pressure in the barrel exerts a great force on the follower plate. Therefore some effort is required for controlling the upward movement of the follower plate.

From DE 201 02 413 U1, a method of the type stated initially is known. In the case of a barrel melting apparatus, a piston acting as a follower plate is introduced into the cylinder space of the barrel and heated, so that it melts material to be conveyed that is situated in the barrel, so that this material can be conveyed out of the barrel. The piston is provided with sealing means that lie against a barrel wall, forming a seal. In order to be able to adapt the piston to barrels having different dimensions, the sealing means can be widened, in particular by means of the introduction of compressed gas. In this regard, it is provided that the sealing means are widened to the desired size before introduction of the piston into the barrel. The sealing means remains at this size until it needs to be adapted to a barrel having a different size. DE 201 02 413 U1 therefore cannot make any contribution to solving the problem that it is difficult to control the upward movement of the follower plate in an emptied barrel. Furthermore, the widened sealing means makes introduction of the follower plate into a new, filled barrel difficult.

It is therefore the task of the invention to further develop a method of the type stated initially in such a manner that the follower plate can be more easily removed from the container and/or can be introduced into the container more easily.

This task is accomplished, according to the invention, by means of a method having the characteristics of claim 1. Advantageous further developments of the invention are the object of the dependent claims.

The invention is based on the idea of varying the sealing effect of the wiper ring in targeted manner, so as, on the one hand, to achieve a good sealing effect when the barrel or the container is filled with viscous material, at least in part, and to prevent penetration of air into the container, and, on the other hand, to cancel out the sealing effect, in whole or in part, when the follower plate is supposed to be removed from the emptied container or introduced into a new, full container. For this purpose, a contact part of the wiper ring, which projects radially outward and is intended for contact against the inner surface of the container wall, can have a variable press-down force applied to it for pressing it against the inner surface. The press-down force is variable in the sense that it can assume at least two different values, wherein a sealing effect is achieved with the one value, while no sealing effect or only a slight sealing effect is achieved with the other value. Between these extreme values, it is furthermore possible to change the press-down force discretely or continuously. It is not only the sealing effect of the wiper ring that can be varied by means of the variation of the press-down force, according to the invention, with which the contact part is pressed against the inner surface of the container wall. The friction force that occurs between the wiper ring and the container wall can be reduced, so as to remove the follower plate out of the container, by reducing the press-down force, and thereby removal of the follower plate out of the container is further facilitated.

It is practical if the follower plate is first introduced into the container before the start of material conveying, and then the contact part is pressed against the inner surface. This facilitates introduction of the follower plate into the container. Preferably, the contact part is only pressed against the inner surface when the follower plate lies on the surface of the material, so that this plate can be moved in the interior of the container almost without friction, until the sealing effect is required. It is advantageous if the follower plate lying on the surface of the material can be detected by means of a sensor, so that the contact part is pressed against the inner surface by means of a control device, on the basis of a signal of the sensor. This allows automation of the introduction of the follower plate into the container, during which the sealing effect is automatically produced at the correct point in time. In this regard, it is possible that the follower plate is moved by means of a lifting device having a spindle drive, and that the sensor detects a change in the torque applied to the spindle of the spindle drive. When the torque increases, the sensor sends a signal to the control device, which device triggers pressing of the contact part against the inner surface. However, it is also possible that the follower plate is suspended on a lifting device and the sensor detects separation of the follower plate from the lifting device. The sensor is then a simple switch, which switches and passes its switching signal on to the control device when the lifting device continues to move downward, but because the follower plate lies on the material, the plate or a rod assembly firmly connected with it is mechanically separated from the lifting device at a contact point. Shutting the downward movement of the lifting device by triggering the switch is also possible.

In order to facilitate lifting the follower plate from the bottom of the emptied container, it is practical if compressed air is introduced into a region between the follower plate and the container bottom. This can be done before the sealing effect between the wiper ring and the container wall is cancelled out, so that the excess pressure that occurs in the container already lifts the follower plate somewhat. However, introduction of compressed air into the container can also take place simultaneously with cancellation of the sealing effect between the wiper ring and the container wall.

According to an advantageous further development of the invention, a detection device can be present, which detects the type of container and sets the press-down force of the contact part as a function of the type of container. In this way, the fact that different containers can have different stability can be taken into account, so that a great press-down force is not harmful for various containers, but can deform other containers, and this is not desirable. In contrast, it is advantageous to set the press-down force to be as great as possible, in order to achieve a good sealing effect.

In order to eliminate the friction force between the wiper ring and the container wall, it can be provided that the contact part can be retracted from the inner side of the container wall by reducing the press-down force. The press-down force is then at zero. The follower plate can then be removed from the container, wherein ideally, the wiper ring does not touch the container wall.

Variation of the press-down force can be implemented in different ways. However, it is preferred that the wiper ring is hollow and has an outer wall that encloses a cavity, which runs at least partially circumferentially. It is practical if the outer wall is thicker in the region of its contact part than in its other regions. It is furthermore advantageous to provide an aeration and ventilation device for the wiper ring, with which air can be introduced into the cavity or drained from it. If pressure is applied to the cavity, then the wiper ring expands, and the press-down force with which the contact part is pressed against the container wall is increased. If the outer wall is thicker in the region of the contact part, more material is available there, so that the sealing effect is improved. In a simple and effective embodiment, the contact part can be moved between a sealing position and a release position by means of the aeration and ventilation device, by applying two predetermined different pressures to the cavity. In the sealing position, it lies against the inner surface of the container wall, forming a seal, while in the release position, the sealing effect is cancelled out.

The follower plate can have a wiper ring. To improve the sealing and stripping effect, at least one further wiper ring can be provided, in advantageous manner, which ring has the same construction as the wiper ring and is disposed at a distance from and parallel to it.

According to an advantageous further development of the invention, a transport device is provided for transporting the container. This transport device is used, in particular, when the lifting device is set up on a building wall, and the follower plate is mounted on a traverse that runs horizontally, by means of at least one holding rod that runs vertically, which traverse is mounted on a lifting device for raising and lowering the traverse, at or close to a first end, while its second end is free and the traverse extends away from the building wall in its longitudinal expanse that runs from the lifting device to the free end. Then it is possible that the transport device transports the container to the follower plate, parallel to the expanse of the building wall, and transports the emptied container away from the follower plate. According to a preferred embodiment, the transport device has a roller track on which the container is set up. Furthermore, it is possible to equip the conveyor apparatus according to the invention with a control device, with which the container is automatically positioned below the follower plate, with which the follower plate is automatically introduced into the container, with which the follower plate is automatically removed from the container after it has been emptied, and with which the emptied container is transported away automatically, by means of the transport device.

Most conveyor pumps have a conveyor cylinder and a conveyor piston that can be moved back and forth in the conveyor cylinder. In this regard, it was determined, at the facility of the applicant, that the speed of the conveyor piston during the conveying process can vary as a function of the material consistency. The applicant found, by means of experiments, that the speed of the conveyor piston is constant, at least within a tolerance range, during the conveying stroke, while the material consistency remains the same. If the conveyed material contains air bubbles, this leads to a significant change in the speed of the conveyor piston during the conveying stroke. Based on this recognition, it is proposed, according to an advantageous further development of the invention, to measure the speed of the conveyor piston during the conveying stroke by means of a measurement device, so that in the event of a change in the measured speed, it is possible to conclude that a change in material consistency has occurred, in particular that air bubbles are present, so that corresponding measures can be initiated. In particular, after the emptied container has been replaced with the filled container, material can be conveyed into a waste container by way of a waste line, by means of an automatic controller that can be integrated into the control device already mentioned above, or implemented by means of a separate control unit, until the measured speed of the conveyor piston lies in a predetermined tolerance range around a predetermined reference speed. Also during the further conveying process, the conveyed material can be checked for the presence of air bubbles by means of measuring the speed of the conveyor piston during the conveying stroke.

Figure 2B:
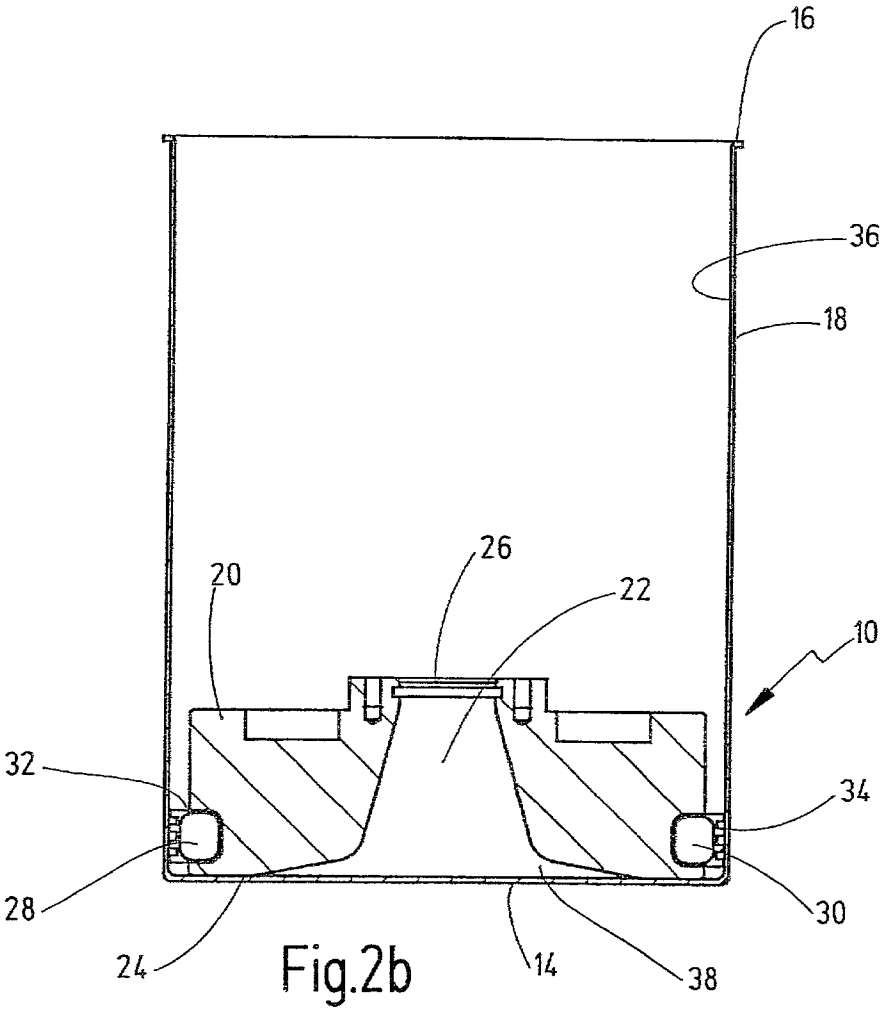
Figure 2A:
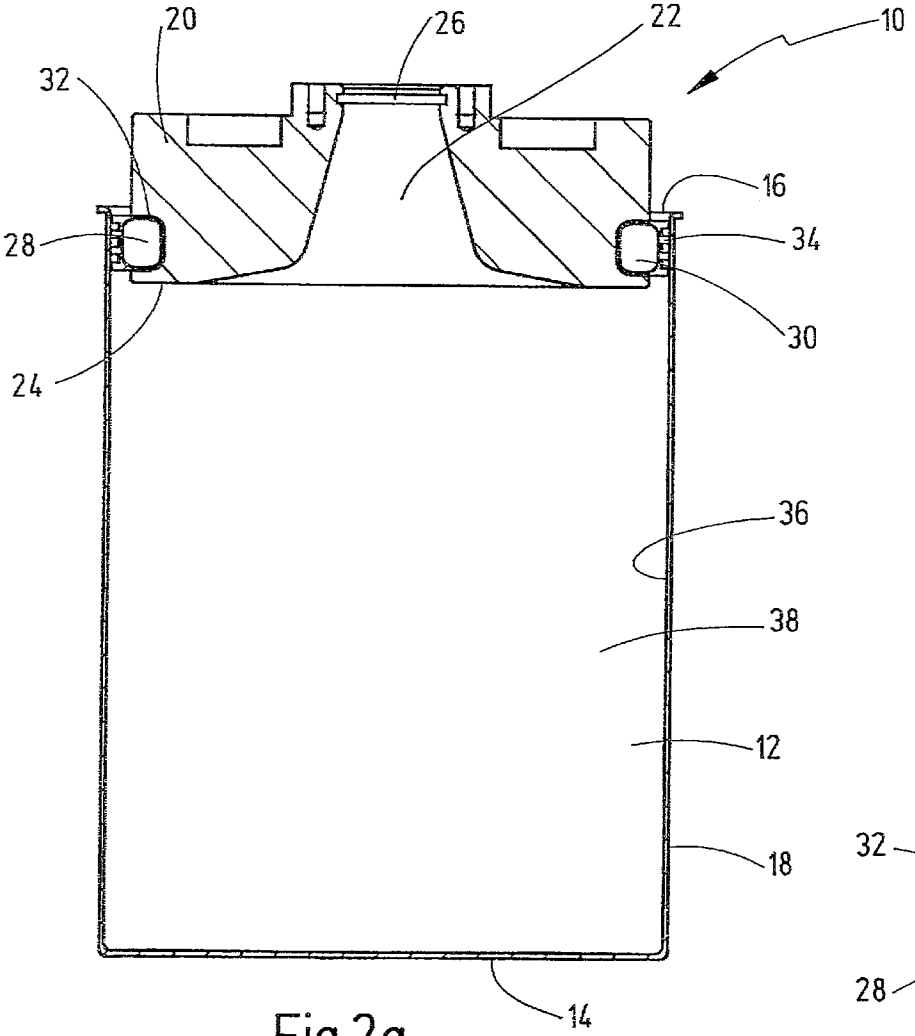
Figure 3B:
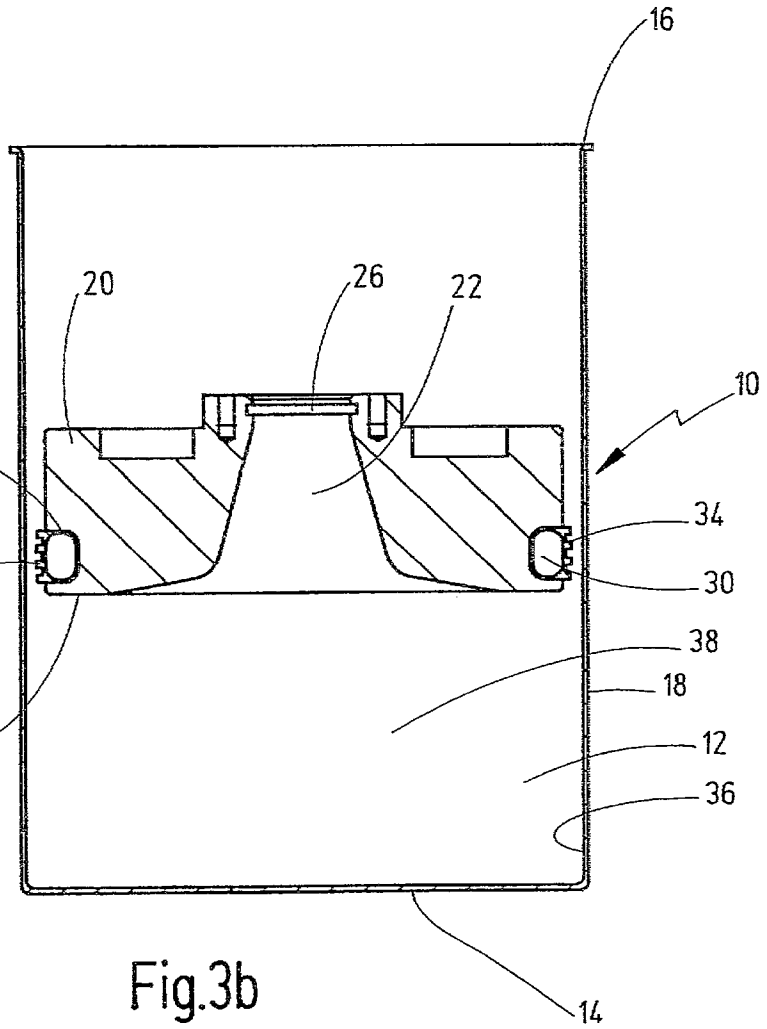
Figure 3A:
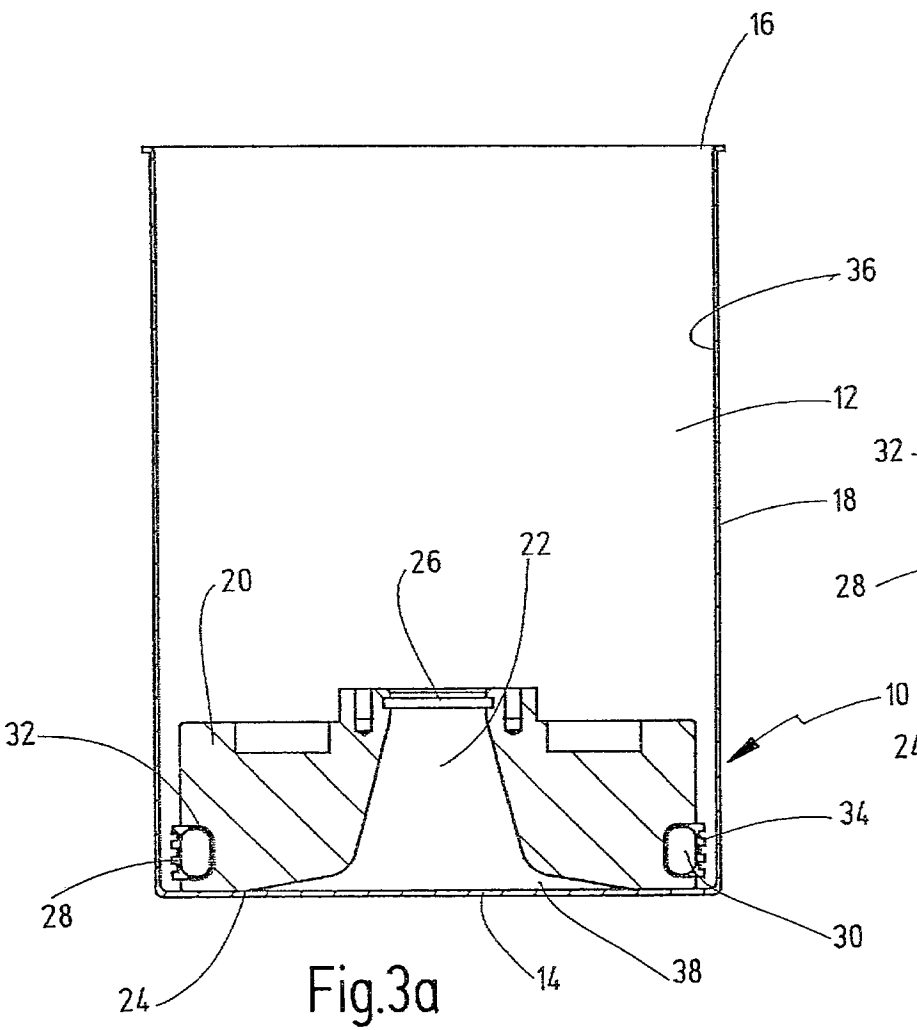
Figure 4:
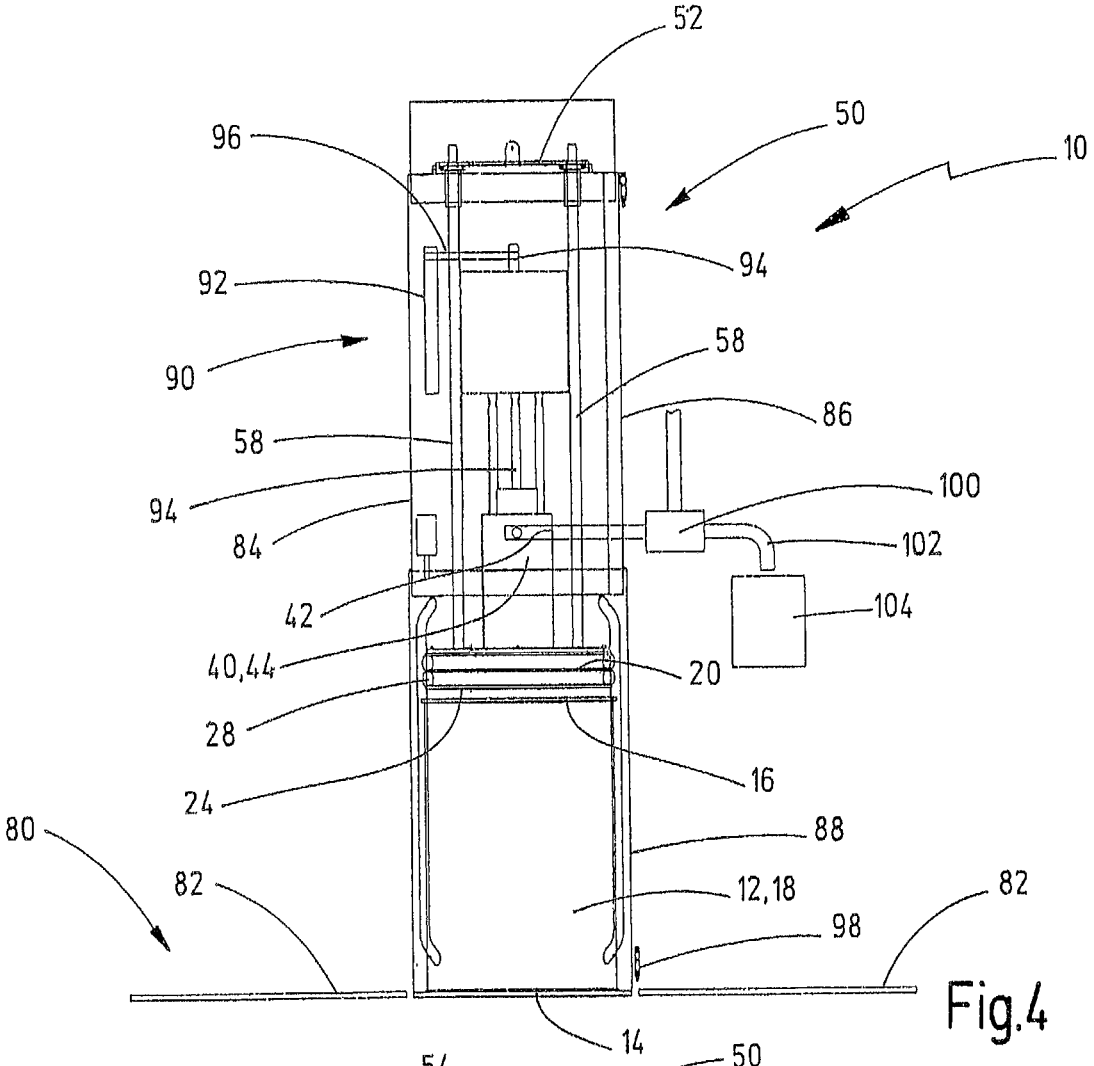

In the following, the invention will be explained in greater detail using an exemplary embodiment shown schematically in the drawing. This shows:

FIG. 1 an apparatus for conveying viscous material, having a follower plate, before its introduction into a container, in a schematic sectional view;

FIG. 2*a*, 2*b* the apparatus according to FIG. 1 with the follower plate introduced into the container, at the beginning and toward the end of the conveying process;

FIG. 3*a*, 3*b* the apparatus according to FIG. 1 with the follower plate situated in the container, in two different positions after the end of the conveying process, and FIG. 4, 5 an apparatus for conveying viscous material in a front view and a top view.

The apparatus 10 shown schematically in the drawing serves for conveying viscous material such as adhesive, sealant or insulation material out of a barrel-like container 12. In this regard, the conveyor apparatus 10 is not shown in all its details, but rather reduced to the components essential for understanding the invention. The container 12 has essentially a cylindrical shape, with a container bottom 14 and a container wall 18 that extends upward from the container bottom 14 up to a container top 16 and runs circumferentially. The container 12 is open to the container top 16.

The conveyor apparatus 10 has a follower plate 20 that is introduced into the container 12 for conveying the material, and lies on the material surface there. The follower plate 20 is disposed on a frame, not shown in FIG. 1, and can be moved up and down by means of a lifting apparatus 50. It has a mandrel 22 in the center, which extends upward from an underside 24 that lies on the material, and opens into a material outlet 26. The material is conveyed out of the material outlet 26 to the location of use by means of a conveyor pump 40, by way of a material line.

The follower plate 20 has a wiper ring 28 composed of elastically expandable material, in the present case of rubber, which ring runs circumferentially, is configured in tubular manner, with an outer wall 32 enclosing a ring-shaped cavity 30. The outer wall 32 is thickened in its region that faces outward radially and projects outward, forming a contact part 34, which is intended for contact against an inner surface 36 of the container wall 18, forming a seal. If compressed air is applied to the cavity 30 by means of an aeration and ventilation device, not shown, the wiper ring 28 expands and the contact part 34 moves radially outward. If the follower plate 20 is introduced into the container 12, the contact part 34 is moved into a sealing position in which it is pressed against the inner surface 36 by the force exerted by the compressed air in the cavity 30, as shown in FIG. 2*a*, 2*b*, and seals the container interior 38, which is situated below the follower plate 20, off from the surroundings.

Before the start of a conveying process, first a container 12 filled with material is made available. The follower plate 20 is introduced into the container interior 38 from above, through the open container top 16, wherein the cavity 30 is ventilated, so that the diameter of the wiper ring 28 is smaller than the inside diameter of the container 12 (see FIG. 1). The follower plate 20 is moved downward, until its underside 24 lies on a surface of the material contained in the container 12. This contact is detected by a sensor that sends a signal to a control device, which triggers introduction of compressed air into the cavity 30. The wiper ring 28 increases its diameter, so that the contact part 34 is moved into the sealing position.

At the start of a conveying process, the follower plate 20 is in the position shown in FIG. 2*a*, in which its underside 24 lies on the surface of the material in the filled container 12. The contact part 34 is situated in its sealing position, so that the wiper ring 28 seals the container interior 38 off from the surroundings. If material is conveyed out of the container 12, the material level drops and the follower plate 20 is moved downward in the container 12, following the material level, by means of the lifting apparatus, wherein the contact part 34 slides over the inner surface 36, overcoming a friction force, and wipes off material adhering to this surface. Once the container has been emptied completely, the follower plate 20 is situated on the container bottom 14, as shown in FIG. 2*b*, wherein possibly a thin material film is still present between the follower plate 20 and the container bottom 14. After the container 12 has been emptied, compressed air is introduced into the mandrel 22, so that the follower plate 20 is lifted off the container bottom 14. At the same time with introduction of compressed air into the mandrel 22, or a short time afterward, the force that presses the contact part 34 against the inner surface 36 is taken away by discharging compressed air out of the cavity 30, so that the contact part 34 withdraws from the inner surface 36. The contact part 34 is then in a release position, in which the sealing effect between the container interior 38 and the surroundings is cancelled out. The follower plate 20 is then lifted out of the container 12 by means of the lifting apparatus 50, until it is back in the position shown in FIG. 1. The empty container 12 can then be replaced by a new, full container, and the conveying process can begin once again.

A conveyor pump 40 firmly connected with the follower plate 20 is connected with the material outlet 26 of the follower plate 20, which pump serves to convey material out of the container 12 into a conveying line 42 that leads to a processing station, by way of the material outlet 26. The conveyor pump 40 has a conveyor cylinder 44, firmly mounted on the follower plate 20, as well as a conveyor piston, not shown in the drawing, which can move back and forth in the conveyor cylinder 44, the linear movement of which piston in the conveyor cylinder 44 draws material into the conveyor cylinder 44 through the material outlet 26 and presses the material out of the conveyor cylinder 44 into the conveying line 42.

Since the follower plate 20 can be introduced into the container 12 almost without contact and without exertion of force, due to the variable diameter of the wiper ring 28, in the event of a container change, a lifting device 50 is provided in the case of the conveyor apparatus 10 according to the invention, on which device a traverse 52 that runs horizontally, in the form of a metal plate is mounted with its first end 54, while its second end 56 is free. Two holding rods 58 run vertically downward from the traverse 52, which rods carry the follower plate 20. The lifting device 50 has a spindle drive, not shown in any detail, which is driven by means of an electric motor, for raising and lowering the traverse 52.

The conveyor apparatus 10 furthermore has a transport device 80, which has a roller track 82, with which the container 12 can be transported in a direction perpendicular to the longitudinal expanse of the traverse 52. In this manner, emptied containers 12 can be transported away from the follower plate 20, and full containers 12 can be transported under the follower plate 20. Furthermore, a housing 84 is provided, which encloses the container 12 and the follower plate 20 all around during introduction of the follower plate 20 into the container 12 and during conveying of the material. The housing 84 has two transparent sliding doors 86, 88 that are disposed one on top of the other and enclose an interior all around, in each instance, which doors enclose the container 12, the follower plate 20, and the conveyor pump 40 during operation, all around, to minimize the risk of injury to operating personnel. In order to have access to the conveyor pump 40, the upper sliding door 86 can be moved downward, while the lower sliding door 88 can be moved upward, so as to allow a change of container. Furthermore, a control device is provided, with which a filled container 12 is positioned under the follower plate 20 fully automatically, by means of advancement on the roller track 82, with which device the follower plate 20 is automatically introduced into the container 12, with which device the follower plate 20 is automatically removed from the container 12 after it is emptied, and with which device the emptied container 12 is automatically transported away by means of the transport device 80. A sensor 98 detects the correct positioning of the container 12 under the follower plate 20.

Figure 5:
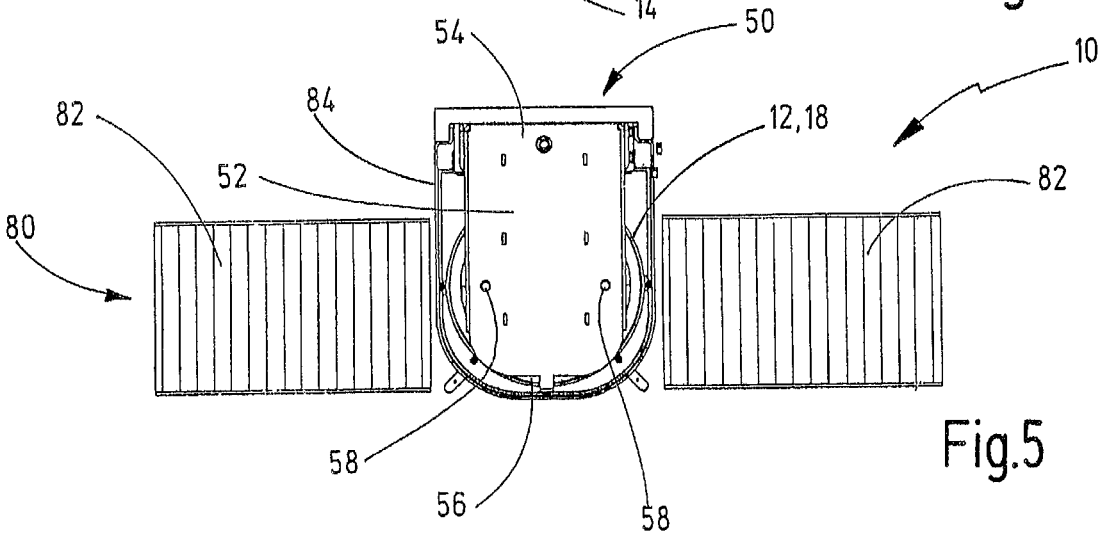

The conveyor apparatus 10 furthermore has a measurement device 90, with which the speed of the conveyor piston during the conveying stroke can be measured. The measurement device 90 has a path measurement unit in the form of an absolute value transducer 92, the housing of which is mounted in the lifting device 50. A piston rod 94 firmly connected with the conveyor piston is passed out of the conveyor cylinder 44 upward, and rigidly connected with a movable element of the absolute value transducer 92 by means of connecting rods 96. The path measurement device 90 furthermore has a control unit, not shown in any detail, which controls conveying of the viscous material as a function of the measured speed of the conveyor piston. The control unit detects when the measured speed of the conveyor piston lies outside of a tolerance range about a predetermined reference speed, which indicates that the consistency of the conveyed material has changed to such an extent that its usability is doubtful. In this case, the control unit switches a valve 100, so that the conveyed material is conveyed not to the processing station but rather to a waste line 102 that branches off from the conveying line 42 and leads to a waste container 104. If the control unit detects that the speed of the conveyor piston lies in the tolerance range again, it switches the valve 100 once again, and the viscous material is conveyed to the processing station once again, by way of the conveying line 42. The measurement device 90 is particularly supposed to prevent material containing air bubbles from being conveyed. It can particularly be used when the follower plate 20 was introduced into a full container 12, so as to convey material into the waste container 104, in an automated process, until it no longer contains any air bubbles. However, it can also be used during the conveying process and detect the air bubbles present in the material, and convey the material containing air bubbles into the waste container 104 instead of to the processing station. In FIG. 5, the representation of the measurement device 90, the valve 100, the waste line 102, and the waste container 104 was left out for the sake of clarity.

In summary, the following should be stated: The invention relates to an apparatus 10 for conveying viscous material out of a barrel-like container 12, having a container bottom 14 and a circumferential container wall 18 that extends from the container bottom 14 to a container top 16, which container is open toward the container top 16, having a follower plate 20 that has a material outlet 26 connected with a conveyor pump, for closing off the container 12, wherein the follower plate 20 has a wiper ring 28 that runs circumferentially around, and wherein the wiper ring 28 has a contact part 34 that projects radially outward, for contact with an inner surface 36 of the container wall 18, which surface faces the follower plate 20. According to the invention, it is provided that the contact part 34 can have a variable contact force applied to it, to press it against the inner surface 36 of the container wall 18.

The invention claimed is:

1. A method for conveying viscous material out of a barrel-like container, having a container bottom and a circumferential container wall that extends from the container bottom to a container top, wherein the container is open toward the container top, the method using an apparatus that has a follower plate for closing off the container, wherein the follower plate has a wiper ring that runs circumferentially around, and wherein the wiper ring has a contact part that projects radially outward, for contact with an inner surface of the container wall, wherein the inner surface faces the follower plate, wherein the contact part can have a variable contact force applied, to press the contact part against the inner surface of the container wall, wherein the follower plate is moved in the direction of the container bottom, following a dropping material level, lying on a surface of the material, and, after the container has been emptied, is moved away from the container bottom, and wherein the wiper ring is pressed against the inner surface of the container wall, with the contact part, forming a seal, during the movement of the follower plate toward the container bottom, wherein during the movement of the follower plate away from the container bottom, the sealing effect between the wiper ring and the container wall is cancelled out by means of reducing the press-down force, wherein before the start of material conveying, first the follower plate is introduced into the container, and then the contact part is pressed against the inner surface, wherein the contact part is only pressed against the inner surface when the follower plate lies on the surface of the material, wherein the follower plate lying on the surface of the material is detected by means of a sensor, and wherein the contact part is pressed against the inner surface by means of a control device, on the basis of a signal of the sensor.

2. The method according to claim 1, wherein the follower plate is moved by means of a lifting device having a spindle drive, and wherein the sensor detects a change in the torque applied to the spindle of the spindle drive.

3. The method according to claim 2, wherein the lifting device and/or the transport device is/are controlled by means of a control device, and a container filled with viscous material is automatically positioned under the follower plate and/or the follower plate is automatically introduced into the container and/or the follower plate is automatically removed from the container after the container has been emptied and/or the emptied container is automatically transported away after removal of the follower plate.

4. The method according to claim 1, wherein the follower plate is suspended on a lifting device and the sensor detects separation of the follower plate from the lifting device.

5. The method according to claim 1, wherein by means of a detection device, the type of container is detected, and the press-down force of the contact part is set as a function of the type of container.

6. The method according to claim 1, wherein during the movement of the follower plate away from the container bottom, the contact part is retracted from the inner surface of the container wall by reducing the press-down force.

7. The method according to claim 1, wherein the wiper ring is hollow and has an outer wall that encloses a cavity, which runs at least partially circumferentially, and wherein the press-down force is varied by means of aerating and ventilating the cavity by means of an aeration and ventilation device.

8. The method according to claim 7, wherein the contact part is moved between a sealing position, in which the contact part lies against the inner surface of the container wall, forming a seal, and a release position, in which the sealing effect with the inner surface of the container wall is cancelled out, so as to produce and cancel out the sealing effect, by means of applying two predetermined different pressures to the cavity, using the aeration and ventilation device.

9. The method according to claim 1, wherein the container is transported under the follower plate and away from the follower plate by means of a transport device.

10. A method for conveying viscous material out of a barrel-like container, having a container bottom and a circumferential container wall that extends from the container bottom to a container top, wherein the container is open toward the container top, the method using an apparatus that has a follower plate for closing off the container, wherein the follower plate has a wiper ring that runs circumferentially around, and wherein the wiper ring has a contact part that projects radially outward, for contact with an inner surface of the container wall, wherein the inner surface faces the follower plate, wherein the contact part can have a variable contact force applied, to press the contact part against the inner surface of the container wall, wherein the follower plate is moved in the direction of the container bottom, following a dropping material level, lying on a surface of the material, and, after the container has been emptied, is moved away from the container bottom, and wherein the wiper ring is pressed against the inner surface of the container wall, with the contact part, forming a seal, during the movement of the follower plate toward the container bottom, wherein during the movement of the follower plate away from the container bottom, the sealing effect between the wiper ring and the container wall is cancelled out by means of reducing the press-down force, and wherein after the container is emptied, compressed air is introduced into a region between the follower plate and the container bottom, to raise the follower plate, when or before the sealing effect between the wiper ring and the container wall is cancelled out.

11. A method for conveying viscous material out of a barrel-like container, having a container bottom and a circumferential container wall that extends from the container bottom to a container top, wherein the container is open toward the container top, the method using an apparatus that has a follower plate for closing off the container, wherein the follower plate has a wiper ring that runs circumferentially around, and wherein the wiper ring has a contact part that projects radially outward, for contact with an inner surface of the container wall, wherein the inner surface faces the follower plate, wherein the contact part can have a variable contact force applied, to press the contact part against the inner surface of the container wall, wherein the follower plate is moved in the direction of the container bottom, following a dropping material level, lying on a surface of the material, and, after the container has been emptied, is moved away from the container bottom, and wherein the wiper ring is pressed against the inner surface of the container wall, with the contact part, forming a seal, during the movement of the follower plate toward the container bottom, wherein during the movement of the follower plate away from the container bottom, the sealing effect between the wiper ring and the container wall is cancelled out by means of reducing the press-down force, and wherein by means of a detection device, the type of container is detected, and the press-down force of the contact part is set as a function of the type of container.

12. A method for conveying viscous material out of a barrel-like container, having a container bottom and a circumferential container wall that extends from the container bottom to a container top, wherein the container is open toward the container top, the method using an apparatus that has a follower plate for closing off the container, wherein the follower plate has a wiper ring that runs circumferentially around, and wherein the wiper ring has a contact part that projects radially outward, for contact with an inner surface of the container wall, wherein the inner surface faces the follower plate, wherein the contact part can have a variable contact force applied, to press the contact part against the inner surface of the container wall, wherein the follower plate is moved in the direction of the container bottom, following a dropping material level, lying on a surface of the material, and, after the container has been emptied, is moved away from the container bottom, and wherein the wiper ring is pressed against the inner surface of the container wall, with the contact part, forming a seal, during the movement of the follower plate toward the container bottom, wherein during the movement of the follower plate away from the container bottom, the sealing effect between the wiper ring and the container wall is cancelled out by means of reducing the press-down force, wherein the follower plate has at least one further wiper ring, which has the same construction as the wiper ring and is disposed at a distance from and parallel to the wiper ring, and wherein the press-down force of the further wiper ring is varied in accordance with the press-down force of the wiper ring.

13. A method for conveying viscous material out of a barrel-like container, having a container bottom and a circumferential container wall that extends from the container bottom to a container top, wherein the container is open toward the container top, the method using an apparatus that has a follower plate for closing off the container, wherein the follower plate has a wiper ring that runs circumferentially around, and wherein the wiper ring has a contact part that projects radially outward, for contact with an inner surface of the container wall, wherein the inner surface faces the follower plate, wherein the contact part can have a variable contact force applied, to press the contact part against the inner surface of the container wall, wherein the follower plate is moved in the direction of the container bottom, following a dropping material level, lying on a surface of the material, and, after the container has been emptied, is moved away from the container bottom, and wherein the wiper ring is pressed against the inner surface of the container wall, with the contact part, forming a seal, during the movement of the follower plate toward the container bottom, wherein during the movement of the follower plate away from the container bottom, the sealing effect between the wiper ring and the container wall is cancelled out by means of reducing the press-down force, wherein the viscous material is conveyed out of the container by means of a conveyor pump, which has a conveyor cylinder and a conveyor piston that can move back and forth in the conveyor cylinder, wherein the speed of the conveyor piston is measured by means of a measurement device, and wherein after an emptied container has been replaced with a filled container, material is conveyed into a waste container, by way of a waste line, until the measured speed of the conveyor piston lies in a predetermined tolerance range about a predetermined reference speed once again.

* * * * *